US007062218B2

(12) United States Patent
Burnett et al.

(10) Patent No.: US 7,062,218 B2
(45) Date of Patent: Jun. 13, 2006

(54) QUAD-ROLL DECURLER

(75) Inventors: Daniel H. Burnett, Fairport, NY (US); Kenneth E. Giunta, Penfield, NY (US); Donald E. Johnston, Rochester, NY (US); Arthur H. Kahn, Cohocton, NY (US); Anthony G. Poletto, Fairport, NY (US); Harry Ramos, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 327 days.

(21) Appl. No.: 10/410,778

(22) Filed: Apr. 9, 2003

(65) Prior Publication Data

US 2004/0042831 A1 Mar. 4, 2004

Related U.S. Application Data

(60) Provisional application No. 60/407,217, filed on Aug. 29, 2002.

(51) Int. Cl.
*G15G 15/00* (2006.01)

(52) U.S. Cl. ..... 399/406; 399/397

(58) Field of Classification Search ..... 399/406, 399/399, 397; 162/271, 270; 242/615.2, 242/615

See application file for complete search history.

(56) References Cited

U.S. PATENT DOCUMENTS

| | | | | | |
|---|---|---|---|---|---|
| 3,971,696 | A | | 7/1976 | Manfredi | 162/271 |
| 4,632,533 | A | * | 12/1986 | Young | 399/406 |
| 5,084,731 | A | * | 1/1992 | Baruch | 399/406 |
| 5,187,527 | A | * | 2/1993 | Forlani et al. | 399/406 |
| 5,396,318 | A | * | 3/1995 | Asada | 399/328 |
| 5,515,152 | A | | 5/1996 | Kuo | 399/406 |
| 5,519,481 | A | * | 5/1996 | Kuo | 399/406 |
| 5,848,347 | A | | 12/1998 | Kuo et al. | 399/406 |
| 6,314,268 | B1 | | 11/2001 | Giunta et al. | 399/406 |

* cited by examiner

*Primary Examiner*—Anthony H. Nguyen
(74) *Attorney, Agent, or Firm*—Joseph M. Young

(57) ABSTRACT

A quad roll sheet curl control apparatus uses elastomer first and second rolls forming first and second nips with third and fourth rolls. The first and second rolls have compressible surfaces, while the third and fourth roll surfaces are formed of a substantially uncompressible material. A pivotable gate member in operating relationship with the first and second nips directs sheets to either the first or the second nip whereby the desired decurling orientation is achieved for the sheet by either the elastomer first roll or the elastomer second roll. Switching nips and curl to be induced does not require drive reversal as previous decurler arrangements do. The degree of decurling can be adjusted with at least one cam in communication with at least one of the first and second rolls.

24 Claims, 4 Drawing Sheets

QUAD-ROLL DECURLER

This application is based on Provisional Patent Application No. 60/407,217, filed Aug. 8, 2002.

This invention relates to a decurling apparatus for decurling sheets of paper, and more particularly this invention relates to an apparatus for reducing sheet curl as induced, for example, by heat and pressure roll type fusers of the type typically employed in a xerographic or electrophotographic or analogous-type printing machines.

BACKGROUND AND SUMMARY

In xerographic and electrostatographic marking machines, a photoconductor P/C, generally comprising a photoconductive insulating material adhered to a conductive backing, is charged uniformly and exposed to a light image of an original document to be reproduced to form latent electrostatic images. The latent electrostatic images are then rendered visible by applying one or more pigmented resins specifically designed for this purpose; these pigmented resins are commonly referred to as toners. In the case of a reusable P/C, the toner that forms the visible images is transferred to plain paper, after which the toner images are affixed to the copy medium, usually through the application of heat and pressure, such as with a roll fuser.

One fuser is the nip forming roll fuser: a roll fuser in which a nip is formed by deforming a softer fuser roll with a biased harder roll, the softer fuser roll being heated and including, for example, an outer deformable coating of silicon rubber. The harder roll is usually not heated and is a pressure roll biased against the softer fuser roll to create the nip therebetween. Copy sheets bearing electrostatically affixed toner images pass through the nip with the images contacting the heated roll.

Roll size depends upon a number of variables, such as the copy making speed of the machine: faster machines use relatively larger rolls, whereas slower machines use smaller diameter rolls (i.e. 1 to 2 inch diameter). With the smaller rolls, copy sheets release or fall away from the nip forming fuser roll, thereby coming to rest on the pressure roll mounted beneath the fuser roll, which can result in the copy sheet taking the general shape of the pressure roll. One such fuser arrangement was found to produce between ½ to 1 inch flat curl, which bends away from the image. The copies in some cases form scrolls and can cause post fuser handling problems, particularly with regard to stacking of the copies in the output tray.

In addition to the fusing operation, as the sheet of support material passes through the various processing stations in, for example, an electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes handling issues as the sheet is processed in the printing machine. Sheets delivered in a curled condition have a tendency to have their edges out of registration with the aligning mechanisms employed in the printing machine. In addition, curled sheets tend to frequently produce jams or misfeeds within the printing machine. This problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the de-curler is not necessarily consistent with that required in electrophotographic printing machines. In addition, decurlers of this type cannot decurl under stress conditions since they do not strain the sheets due to belt flexing.

Various approaches have been devised to improve sheet de-curlers such as described in U.S. Pat. No. 4,326,915 to Mutschler, U.S. Pat. No. 4,571,054 to Bowler, Jr., U.S. Pat. No. 4,591,259 to Kuo, et al., U.S. Pat. No. 4,627,718 to Wyer, U.S. Pat. No. 5,237,381 to Hamada, U.S. Pat. No. 5,270,778 to Wyer, U.S. Pat. No. 5,548,389 to Bowler, Jr., U.S. Pat. No. 5,848,347 to Kuo, et al. The disclosures of the foregoing patents are incorporated by reference into the disclosure of the instant patent application.

These and other prior technologies demonstrate a need for an improved decurler, especially a decurler for use in a xerographic or electrophotographic printer that is able to decurl in the direction towards the image on the sheet as well as decurling in the direction away from the image on the sheet. Previously, this has been accomplished by using two separate decurlers, one for each curl direction. In addition, instead of the need for an expensive support structure for a decurler apparatus, there exists a need for a simple and relatively inexpensive decurler apparatus. In addition to these and all the other advantages of a decurler apparatus as referred to above, it would be advantageous if the user of a xerographic or electrophotographic printer having a decurler apparatus as part of its finishing process could easily adjust the amount of decurling in the paper sheets. Accordingly, embodiments provide a new and improved decurler apparatus for use in a printing machine such as a xerographic or electrophotographic printer that will exhibit all of the specific advantages referred to above.

All of the foregoing advantages and others in accordance with the features of embodiments are attained by embodiments including first, second, third, and fourth rolls configured to form first and second nips, with the first nip comprising the first and second rolls and the second nip comprising the third and fourth rolls. Respective bearings support ends of the first and second rolls, but the third and fourth rolls are supported by the first and second rolls. In embodiments, the third and fourth rolls each have a substantially uncompressible surface, while the first and second rolls each have a compressible surface into which the third and fourth rolls selectively penetrate, respectively. A curl adjuster connected to the first and second nips controls the selective penetration of the compressible surfaces by the substantially uncompressible surfaces. A gate member in communication with the first and second nips sends sheets to one of the first and second nips for application of respective types of curl. At least one of the compressible first and second rolls comprises an elastomer as the compressible surface, and in embodiments, both the first and second rolls comprise an elastomer and outer surfaces of both the first and the second rolls are formed of the same elastomer material.

The first roll and the second roll can each be independently engaged by a respective cam, but embodiments provide for linkage of the two so that forces imposed by the curl adjuster and the rolls remain balanced. In addition, at least one bearing can be employed to support the third and fourth rolls. In embodiments, the at least one bearing supporting the third and fourth rolls is a block of low-friction material against which the third and fourth rolls bear. The at least one bearing can be, for example, a respective block of low-friction material against which the third and fourth rolls bear, or the at least one bearing can be at least one roller type bearing. If the at least one bearing is a block of low-friction material, at least a coating of fluoropolymer can be advantageous as the low-friction material.

The curl adjuster can comprise one curl adjustment device operative to adjust the amount of curl induced by the first nip and another curl adjustment device operative to adjust the amount of curl induced by the second nip. Embodiments employ a cam on a cam shaft driven by an actuator such that rotation in one direction forces one roll of a respective nip against the other roll of the respective nip. The cam can bear on a cam follower that includes a spring such that a resultant spring force is what forces the one of roll toward the other rolls. Advantageously, the curl adjuster can include respective curl adjustment devices for the first and second nips, with springs biasing one roll of each nip against the other roll of each nip. In such a dual-adjustment arrangement, each curl adjustment device can include a cam on a cam shaft driven by an actuator to adjust an amount of bias induced on the rolls by the spring, the actions of the actuators being linked to preserve force balances and/or distributions.

In other words, embodiments contemplate a quad-roll decurler including first and second nips configured to induce different curls in sheets passing therethrough. Each nip includes a compressible roll and a substantially uncompressible roll. At least one curl adjuster adjusts an amount of curl induced by at least one respective nip, and a decision gate sends sheets to one of the first and second nips in response to curl of the sheets. At least one bearing supports the uncompressible rolls, and the at least one bearing can be at least one block of low-friction material against which at least a portion of one or both of the uncompressible rolls bears. Alternatively, a plurality of blocks can support the at least one portions of the uncompressible rolls. In either case, the low-friction material can be at least a coating of a fluoropolymer, such as PTFE.

In still other words, embodiments contemplate a quad-roll decurler comprising two nips each exerting pressure on sheets passing therethrough, the pressure inducing curl in the sheets, and the decurler further comprising a curl adjustment device that adjusts the pressure exerted by at least one of the nips to adjust an amount of curl induced by the at least one of the nips. A base pressure can be induced by a spring extending between the two nips, and the curl adjustment device can counteract the base pressure of the spring to adjust the pressure. The pressure in each nip results from penetration of a substantially non-compressible pinch roll into a compressible roll, the penetration resulting from the action of at least one actuator.

As a result of the configuration of embodiments, the degree of curl induced by the first and second nips can be adjusted via the curl adjustment device. Advantageously, unlike previous decurlers, no drive reversal is required to switch from curl being applied in one direction by one of the nips to curl being applied to the opposite direction by the other nip.

Additional advantages of embodiments will be set forth in part in the description that follows, and some will be apparent from the description, or may be learned by practice of the invention in accordance with various features and combinations as particularly pointed out in the appended claims.

BRIEF DESCRIPTION OF THE DRAWINGS

The accompanying drawings which are incorporated in and constitute a part of the specification illustrate one embodiment of the invention and, together with the following detailed description, serve to explain the principles of embodiments.

DETAILED DESCRIPTION

Figure 1:
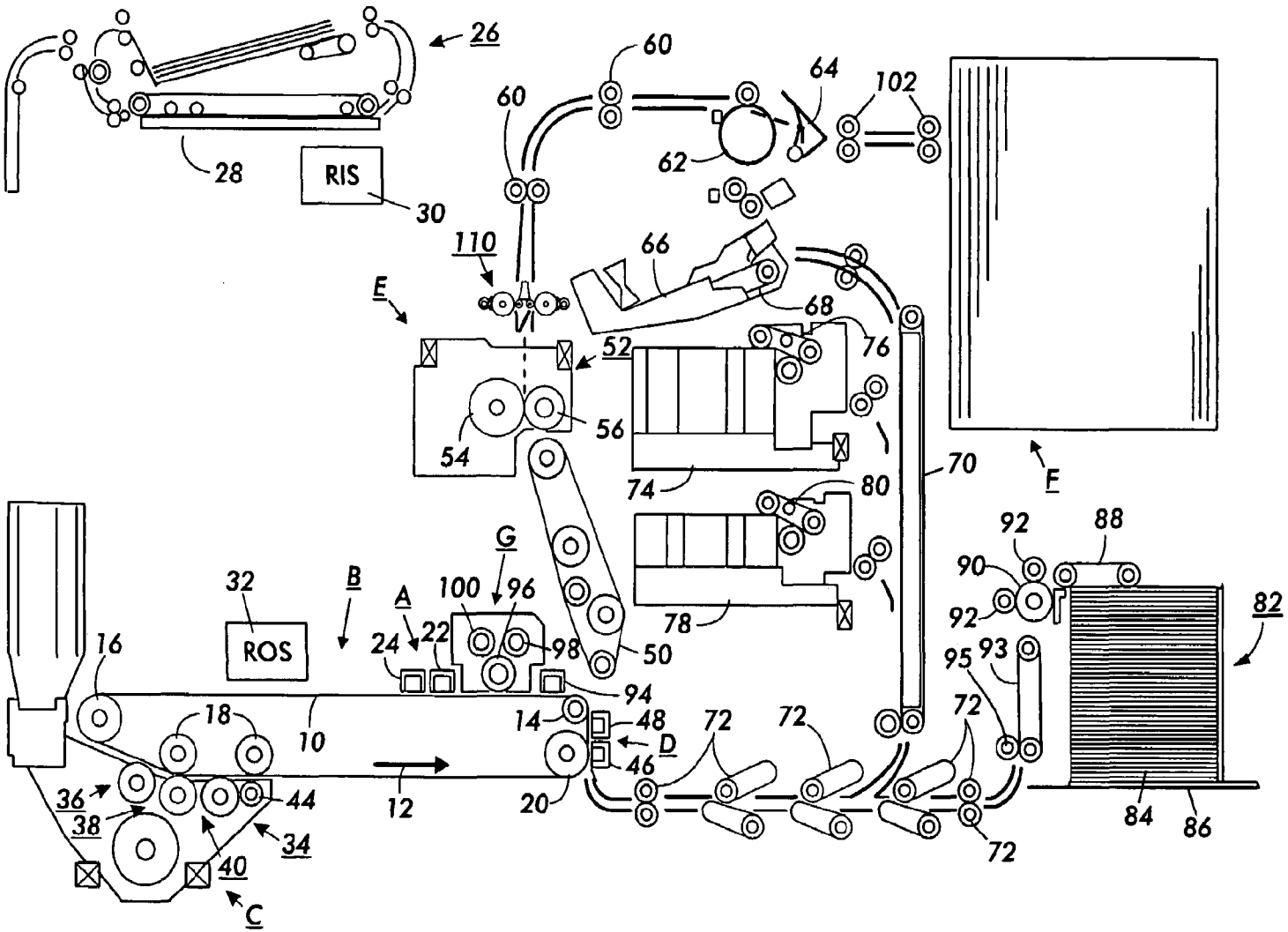
FIG. 1 is a schematic view depicting an illustrative electrophotographic printing machine incorporating a sheet decurling apparatus according to embodiments.

While exemplary embodiments are described, it will be understood that these are not intended to limit the invention to the embodiments described. For a general understanding of the features of embodiments, reference is made to the accompanying drawings. In the drawings, like reference numerals have been used throughout to identify identical elements.

FIG. 1 schematically depicts an electrophotographic printing machine in which embodiments of the instant quad-roll sheet curl control apparatus embodiments can be employed. It will become evident from the following discussion that the decurler apparatus of embodiments can be employed in a wide variety of devices and is not specifically limited in its application to the particular embodiment depicted herein which is given solely to illustrate an example of where the decurler apparatus having the features of embodiments can be used.

Referring to FIG. 1 of the drawings, the electrophotographic printing machine employs a photoconductive belt 10 made, for example, from a photoconductive material coated on a grounding layer that, in turn, is coated on an anti-curl backing layer as is known in the art. In accordance with the features of embodiments, other suitable photoconductive materials, grounding layers, and anti-curl backing layers may also be employed. The belt 10 moves in the direction of arrow 12 through the various processing stations disposed about the path of movement thereof, and is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surfaces passes through the charging station A. At charging station A, one or more corona generating devices 22, 24 charge the belt 10. Next, the charged portion of the belt 10 proceeds to imaging station B. At imaging station B, a document handling unit 26 positioned over platen 28 of the printing machine can sequentially feed documents from a stack of documents placed by the operator in the document stacking and holding tray by conventional methods. Imaging of a document is achieved by a raster input scanner 30 as is conventional in the art. A raster output scanner 32 transmits a processed image of the original document onto the charged portion of the photoconductive surface of belt 10 to selectively dissipate the charge thereon, creating an electrostatic latent image on the belt 10 that corresponds to the informational areas contained within the original document. Thereafter, the belt 10 advances the electrostatic latent image to development station C, where the electrostatic latent image is converted into a toner powder image as is known in the art.

The belt 10 proceeds to transfer station D, where a copy sheet is moved into contact with the toner powder image, also as is known in the art. After transfer, a corona generator 48 or the like charges the copy sheet to the opposite polarity to detach the copy sheet from belt 10, and a conveyer 50 advances the copy sheet to fusing station E.

Fusing station E includes a fuser assembly, indicated generally by the reference numeral 52, that affixes the transferred toner powder image to the copy sheet. Typically, the fuser assembly 52 will include a heated fuser roller 54 with which the powder toner image on the copy sheet comes into contact, and a pressure roller 56 that pushes the copy sheet against the fuser roller 54. The pressure roller is cammed against the fuser roller to provide the necessary pressure to fix the toner powder image to the copy sheet. The fuser roll can be internally heated by a quartz lamp, but other heat sources can be used as is known in the art. Additionally, a release agent, stored in a reservoir, can be pumped to a metering roll, which transfers the agent to a donor roll, and thence to the fuser roll to assist in release of the copy sheet from the fuser roll 54. A trim blade can also be included to trim off excess release agent.

After fusing, the copy sheets often exhibit curl in one direction or another as a result of various conditions of the copy sheets, the toner, and the machine environment. To reduce or eliminate such curl, the copy sheets are fed through a decurler 110. Decurler 110 bends the copy sheet in such a way that the sheet curl is substantially eliminated. The details of the decurler apparatus 110 in accordance with the features of embodiments will be described with reference to FIG. 2. After passing through the decurler 110, the copy sheets are moved by forwarding rollers 60 and other media handlers through duplexing stations and/or finishers, and finally to the output of the machine.

The various machine functions are regulated by a controller, such as a programmable microprocessor that controls all machine functions. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
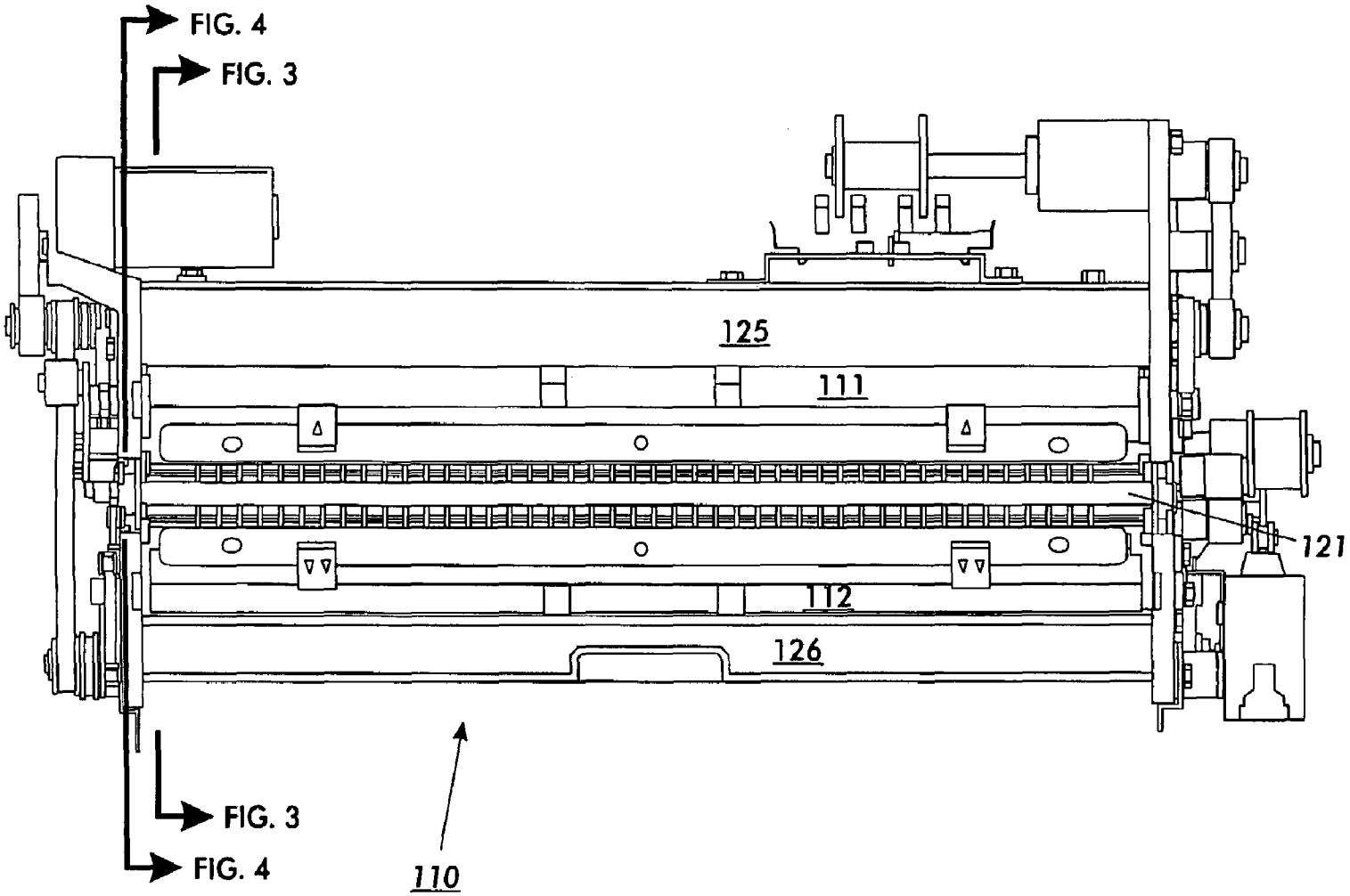
FIG. 2 is a schematic view illustrating a quad-roll decurling apparatus in accordance with embodiments and that can be used in electrophotographic printing machines, such as that illustrated in FIG. 1.
Figure 3:
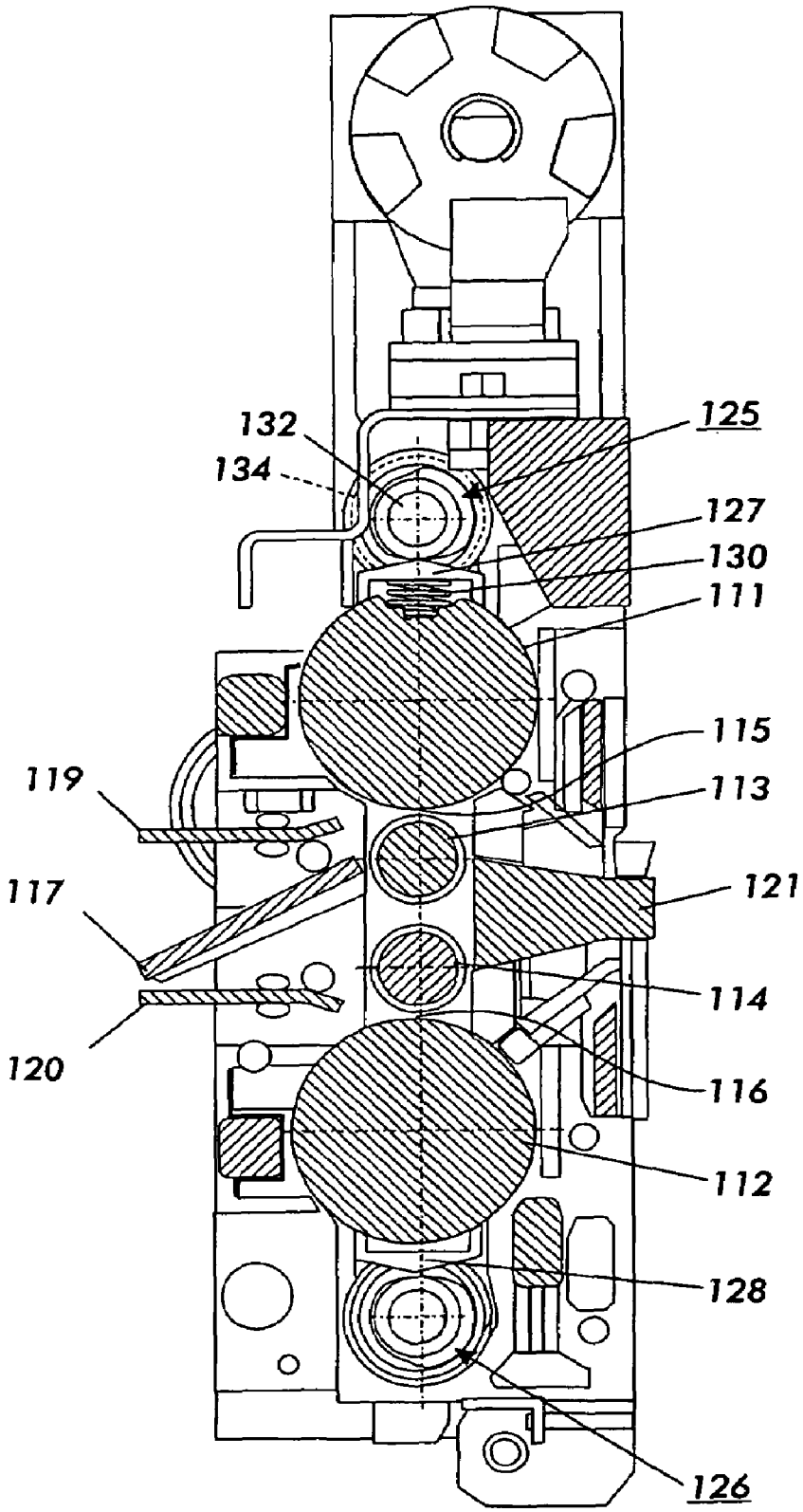
FIG. 3 is a schematic view of the decurling apparatus of FIG. 2 taken along the line A—A.
Figure 4:
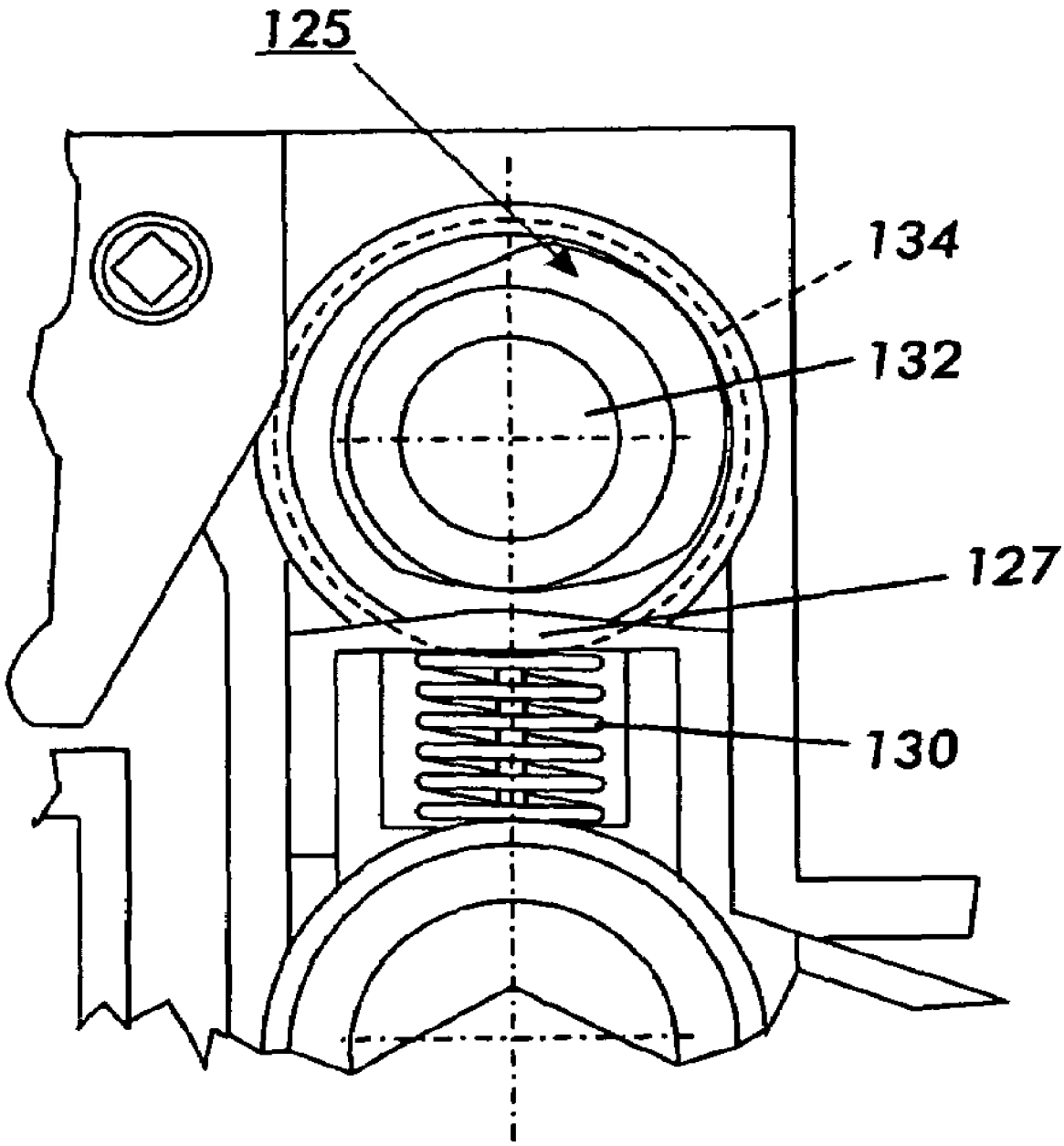
FIG. 4 is a schematic view of the decurling apparatus of FIG. 2 taken along the line D—D.

A particular decurling apparatus or decurler 110 according to embodiments is shown in FIG. 2. Decurling apparatus 110 removes the curl in a sheet of media, such as a sheet of paper, that has been, for example, subjected to an imaging process by the electrophotographic printer illustrated in FIG. 1, for example, due to the fuser operation in Fusing Station E. Curling can also occur by straining the sheet about a small diameter during the printing process. The decurling apparatus 110 in accordance with embodiments is more compact than prior devices with similar function, permitting space constraints to be optimized.

The apparatus 110 comprises a four roll structure including first and third soft elastomer rolls 111, 112. These rolls 111, 112 are preferably constructed of at least an outer coating of an elastomeric material having a compressible outer surface, such as any of the well-known silicone-based elastomers. The particular elastomer material chosen for the outer surface of soft rolls 111, 112 in accordance with the features of embodiments depends to a large extent on the desired or required degree of compression to which the rolls 111, 112 will be subjected. In any event, the same elastomer material is employed as the outer compressible surface of both rolls 111, 112. Rolls 111 and 112 ride on hard drive rolls 113, 114 whose outer surfaces are formed of a hard, non-compressible material, such as a metallic material, though suitable ceramic and other materials could also be used. The outer surface of the hard rolls 113, 114 can advantageously be formed of numerous metallic materials to achieve the desired hard, non-compressible outer surface, such as, for example, a tool steel material. Each of the soft compressible rolls 111, 112 form a respective nip with a respective hard, non-compressible, roll 113, 114. Soft compressible roll 111 forms a first nip 115 with one hard, non-compressible roll 113, and soft compressible roll 112 forms a second nip 116 with the other hard, non-compressible roll 114. The quad-roll decurler 110 according to embodiments thus includes two hard (non-compressible) drive rolls 113, 114 between two soft (compressible) elastomer rolls 111, 112. An advantageous feature of embodiments is that the backer systems or structural support systems of decurler 110 are the elastomer rolls 111 112 of the decurler 110 itself; the decurler 110 in embodiments uses one of the elastomer (soft compressible) rolls 111, 112 as a structural member while at the same time using the other elastomer (soft compressible) roll 111 or 112 as the de-curler roll. In operation, the elastomer roll 111, 112 used to function as a structural member presses against the respective hard roll 113, 114. Since the elastomer rolls 111, 112 have a compressible surface, and the hard drive rolls 113, 114 have non-compressible surfaces, any tendency for the hard drive rolls 113, 114 to deflect will be prevented by the absorption of the compressive forces from the hard drive rolls 113, 114 to either of the soft/compressible elastomer rolls 111, 112.

Decurling apparatus 110 includes a pivotable sheet guide or pivotable gate indicated generally by reference number 117. As the sheet of media (e.g. paper) advances in the direction of arrow 118, it passes between sheet metal guides 119, 120. The full length pivotable gate 117 pivots to direct the sheets to obtain the desired decurling orientation. Thus, the gate 117 directs the sheet to the first nip 115 or the second nip, depending on the desired decurling direction. If the sheet passes through the first nip 115, the elastomer roll 111 and hard roll 113 perform the de-curling operation. As the one roll 111 is the decurling roll, the other elastomer roll 112 will function as a structural member, absorbing the compressive forces of the hard roll 113 to prevent deflection of the hard roll. If the sheet passes through the second nip 116, the other elastomer roll 112 and the other hard roll 114 perform the de-curling operation, while the elastomer first roll 111 functions as a structural member absorbing the compressive forces of hard roll 114 to prevent deflection of the hard roll.

The full length gate 117 pivots to direct the sheet such that AI (i.e. away from the image on the sheet) or TI (i.e. toward the image on the sheet) decurling is achieved. The function of the gate 117 is to direct the paper sheet from, for example, a fuser operation to the top two rolls or the bottom two rolls of decurler 110 depending on the curl itself after fusing. The controller for pivoting the gate can be a simple pivoting device driven by a solenoid. Alternate drives for the gate can include piezoelectric, electrostatic, electromagnetic, fluidic, and mechanical drives.

In the embodiment of a de-curler apparatus 110 as illustrated in FIG. 2, the hard drive roll 114 does not translate to form either the de-curling nips 115 or 116, but the compressible elastomer decurler rolls 111 or 112 are cammed independently by driving cams 125 and 126 which, as illustrated, drive cam followers 127 and 128 respectively. A rocker arm (not shown) and spring mechanism 130 place a compressive force on each of cam followers 127 and 128.

The invention for a de-curler apparatus as described herein also provides for a system that is totally in linear loading, i.e., a linear loaded mechanism to minimize any deflection. The design for a linear actuating mechanism consists of two cam shafts driven by a stepper motor that when turned will move the elastomer rolls toward a central 6 mm diameter steel roll. End blocks can be used to hold bearings for the drive shaft, elastomer rolls and cam shaft. A gate is also supported on the drive shaft to direct the sheet into either of the nips.

Roll 114 can be driven by a servomotor instead of the more typical stepper motor, depending on the needs of the particular device. Another feature that is an advantage of decurler 110 is that the curl on the sheet can be adjusted on the fly using the user interface of the machine that incorporates the decurler apparatus of this invention, i.e., the user of the machine can adjust the degree of decurl depending on variables such as, for example, the type of paper used, the humidity, etc.

Embodiments thus include first, second, third, and fourth rolls 111, 112, 113, 114 configured to form first and second nips 115, 116, with the first nip 115 comprising the first and third rolls 111, 113 and the second nip 116 comprising the second and fourth rolls 112, 114. Respective bearings support ends of the first and second rolls 111, 112, but the third and fourth rolls 113, 114 are supported by the first and second rolls 111, 112. In embodiments, the third and fourth rolls 113, 114 each have a substantially uncompressible surface, while the first and second rolls 111, 112 each have a compressible surface into which the third and fourth rolls 113, 114 selectively penetrate, respectively. A curl adjuster 120 connected to the first and second nips 115, 116 controls the selective penetration of the compressible surfaces by the substantially uncompressible surfaces. A gate member 117 in communication with the first and second nips 115, 116 sends sheets to one of the first and second nips 115, 116 for application of respective types of curl. At least one of the compressible first and second rolls 111, 112 comprises an elastomer as the compressible surface, and in embodiments, both the first and second rolls 111, 112 comprise an elastomer and outer surfaces of both the first and second rolls 111, 112 are formed of the same elastomer material.

The first roll 111 and the second roll 112 can each be independently engaged by a respective cam 125, 126, but embodiments provide for linkage of the two so that forces imposed by the curl adjuster 120 and the rolls 111, 112, 113, 114 remain balanced. In addition, at least one bearing can be employed to support the third and fourth rolls 113, 114. In embodiments, the at least one bearing supporting the third and fourth rolls 113, 114 is a block of low-friction material against which the third and fourth rolls 113, 114 bear. The at least one bearing can be, for example, a respective block of low-friction material against which the third and fourth rolls 113, 114 bear, or the at least one bearing can be at least one roller type bearing. If the at least one bearing is a block of low-friction material, at least a coating of fluoropolymer can be advantageous as the low-friction material.

The curl adjuster 120 can comprise one curl adjustment device 125 operative to adjust the amount of curl induced by the first nip 115 and another curl adjustment device 126 operative to adjust the amount of curl induced by the second nip 116. Embodiments of each curl adjustment device 125, 126 can employ, for example, a cam on a cam shaft driven by an actuator such that rotation in one direction forces one roll of a respective nip 115, 116 against the other roll of the respective nip 115, 116. The cam can bear on a cam follower that includes a spring such that a resultant spring force is what forces the one of roll toward the other rolls. Advantageously, the curl adjuster can include respective curl adjustment devices for the first and second nips, with springs biasing one roll of each nip against the other roll of each nip. In such a dual-adjustment arrangement, each curl adjustment device can include a cam on a cam shaft driven by an actuator to adjust an amount of bias induced on the rolls by the spring, the actions of the actuators being linked to preserve force balances and/or distributions.

In other words, embodiments contemplate a quad-roll decurler including first and second nips 115, 116 configured to induce different curls in sheets passing therethrough. Each nip 115, 116 includes a compressible roll 111, 112 and a substantially uncompressible roll 113, 114. At least one curl adjuster 125, 126 adjusts an amount of curl induced by at least one respective nip 115, 116, and a decision gate 117 sends sheets to one of the first and second nips 115, 116 in response to curl of the sheets. At least one bearing 121 supports the uncompressible rolls 113, 114, and the at least one bearing 121 can be at least one block of low-friction material against which at least a portion of one or both of the uncompressible rolls 113, 114 bears. Alternatively, a plurality of blocks can support the at least one portions of the uncompressible rolls. In either case, the low-friction material can be at least a coating of a fluoropolymer, such as PTFE.

In still other words, embodiments contemplate a quad-roll decurler comprising two nips 115, 116 each exerting pressure on sheets passing therethrough, the pressure inducing curl in the sheets, and the decurler further comprising a curl adjustment device 125, 126 that adjusts the pressure exerted by at least one of the nips 115, 116 to adjust an amount of curl induced by the at least one of the nips 115, 116. A base pressure can be induced by a spring extending between the two nips 115, 116, and the curl adjustment device can counteract the base pressure of the spring to adjust the pressure. The pressure in each nip results from penetration of a substantially non-compressible pinch roll 113, 114 into a compressible roll 111, 112, the penetration resulting from the action of at least one actuator 125, 126.

While this invention has been described in conjunction with a specific embodiment thereof, it is evident that unforeseeable alternatives, modifications, and variations will arise. Accordingly, the invention is intended to embrace all such alternatives, modifications and variations that fall within the spirit and broad scope of the appended claims.

The invention claimed is:

1. A quad-roll curl control apparatus comprising:

first, second, third, and fourth rolls configured to form first and second nips;

the first, second, third, and fourth rolls also configured in a substantially linear formation;

the first nip comprising the first and third rolls;

the second nip comprising the second and fourth rolls;

respective bearings supporting ends of the first and second rolls;

the third and fourth rolls each having a substantially uncompressible surface;

the first and second rolls each having a compressible surface into which the third and fourth rolls selectively penetrate, respectively;

a curl adjuster connected to the first and second nips to control the selective penetration of the first and second roll compressible surfaces by the third and fourth roll substantially uncompressible surfaces; and a gate member in communication with the first and second nips, the gate member sending sheets to one of the first and second nips for application of respective types of curl.

2. The apparatus of claim 1 wherein at least one of the first and second rolls comprises an elastomer.

3. The apparatus of claim 2 wherein both the first and second rolls comprise an elastomer and outer surfaces of both the first and the second rolls are formed of the same elastomer material.

4. The apparatus of claim 1 wherein the first and second rolls support the third and fourth rolls.

5. The apparatus of claim 1 wherein the first roll and the second roll are each independently engaged by a respective cam.

6. The apparatus of claim 1 further comprising at least one bearing supporting the third and fourth rolls.

7. The apparatus of claim 6 wherein the at least one bearing supporting the third and fourth rolls is a block of low-friction material against which the third and fourth rolls bear.

8. The apparatus of claim 6 wherein the at least one bearing supporting the third and fourth rolls is a respective block of low-friction material against which the third and fourth rolls bear, respectively.

9. The apparatus of claim 6 wherein the at least one bearing is at least one roller type bearing.

10. The apparatus of claim 1 wherein the curl adjuster comprises one curl adjustment device operative to adjust the amount of curl induced by the first nip and another curl adjustment device operative to adjust the amount of curl induced by the second nip.

11. The apparatus of claim 1 wherein the curl adjuster includes a cam on a cam shaft driven by an actuator such that rotation in one direction forces one roll of a respective nip against the other roll of the respective nip, the cam bearing on a cam follower that includes a spring such that a resultant spring force is what forces the one of roll toward the other rolls.

12. The apparatus of claim 1 wherein the curl adjuster includes respective curl adjustment devices for the first and second nips, a spring biases one roll of each nip against the other roll of each nip, and each curl adjustment device includes a cam on a cam shaft driven by an actuator to adjust an amount of bias induced on the rolls by the spring.

13. The apparatus of claim 1 wherein the sheet is received from a fusing process of a xerographic printer.

14. A quad-roll decurler including first and second nips configured to induce different curls in sheets passing therethrough, each nip including a compressible roll and a substantially uncompressible roll, the compressible roll supporting the uncompressible roll, the decurler further comprising at least one curl adjuster that adjusts an amount of curl induced by at least one respective nip, and a decision gate that sends sheets to one of the first and second nips in response to curl of the sheets.

15. The decurler of claim 14 further comprising at least one bearing supporting the uncompressible rolls.

16. The decurler of claim 15 wherein the at least one bearing is at least one block of low-friction material against which at least a portion of at least one of the uncompressible rolls bears.

17. The decurler of claim 16 wherein the at least one portions of both uncompressible rolls bear against one block.

18. The decurler of claim 16 wherein respective at least one portions of each uncompressible roll bear against a respective one of two blocks.

19. The decurler of claim 16 wherein a plurality of blocks support the at least one portions of the uncompressible rolls.

20. The decurler of claim 16 wherein the low-friction material is a fluoropolymer.

21. The decurler of claim 15 wherein the at least one bearing is at least one roller bearing against which at least a portion of at least one of the uncompressible rolls bears.

22. A quad-roll decurler comprising four rolls in a substantially linear formation, and wherein the rolls form two nips each exerting pressure on sheets passing therethrough, the pressure inducing curl in the sheets, and further comprising a curl adjustment device that adjusts the pressure exerted by at least one of the nips to adjust an amount of curl induced by the at least one of the nips.

23. The quad-roll decurler of claim 22 wherein a base pressure is induced by a spring extending between the two nips and the curl adjustment device counteracts the base pressure of the spring to adjust the pressure.

24. The quad-roll decurler of claim 22 wherein the pressure in each nip results from penetration of a substantially non-compressible pinch roll into a compressible roll, the penetration resulting from at least one actuator.

* * * * *